US007896183B2

(12) United States Patent
McKenzie

(10) Patent No.: US 7,896,183 B2
(45) Date of Patent: Mar. 1, 2011

(54) EASY ACCESS REFUSE CONTAINER

(76) Inventor: Jimmy B. McKenzie, Clinton, NC (US)

( * ) Notice: Subject to any disclaimer, the term of this patent is extended or adjusted under 35 U.S.C. 154(b) by 848 days.

(21) Appl. No.: 11/881,670

(22) Filed: Jul. 27, 2007

(65) Prior Publication Data

US 2009/0026208 A1 Jan. 29, 2009

(51) Int. Cl.
*B65D 6/24* (2006.01)
*B65D 8/14* (2006.01)
*B65D 25/16* (2006.01)

(52) U.S. Cl. ..... 220/4.34; 220/4.29; 220/495.06; 220/622; 220/693; 220/908

(58) Field of Classification Search ..... 220/495.06, 220/4.29, 4.34, 621, 618, 615, 908, 908.1, 220/693, 622
See application file for complete search history.

(56) References Cited

U.S. PATENT DOCUMENTS 1,117,544 A 11/1914 Barash
1,133,072 A * 3/1915 Vanstrom ..... 220/4.34
1,157,008 A * 10/1915 Lang ..... 220/6
3,063,591 A 11/1962 Laginestra
4,167,271 A * 9/1979 Jorgensen ..... 280/79.5
4,923,080 A * 5/1990 Lounsbury ..... 220/600
4,955,497 A 9/1990 Winden
4,972,950 A 11/1990 Shillington
5,123,562 A 6/1992 Bullard
5,195,501 A 3/1993 Ault
5,361,978 A 11/1994 Monroe
5,372,269 A 12/1994 Sutton
5,901,872 A 5/1999 Zollinhoffer
6,109,002 A * 8/2000 McCabe ..... 53/390
6,179,151 B1 1/2001 Radvansky
6,508,377 B1 * 1/2003 Griswold et al. ..... 220/495.06
6,732,880 B1 * 5/2004 Nash, Sr. ..... 220/495.06
2003/0006237 A1 * 1/2003 Passantino et al. ..... 220/495.06
2005/0230572 A1 * 10/2005 Fisher ..... 248/97
2005/0247718 A1 * 11/2005 Bushby ..... 220/625

* cited by examiner

*Primary Examiner*—Anthony Stashick
*Assistant Examiner*—Niki M Eloshway
(74) *Attorney, Agent, or Firm*—Robert M. M. Seto

(57) ABSTRACT

A refuse container comprising a lower member having lower side walls, upper wall sections, a hinge for pivotally mounting the upper wall sections one to the other such that the upper wall sections may be opened and closed, at least one section fastener for securing the upper wall sections together in a closed position, and a wall securing device that provides support for coupling the upper wall sections to the lower side walls. The present invention allows both of the upper walls sections to be releasably attached to the lower side walls using a combination of annular protrusions and recesses, and at least one section fastener that couples the upper wall sections to each other, thereby allowing easy access to the contents of the container such that a trash liner may be easily removed and the refuse container may be easily cleaned.

13 Claims, 8 Drawing Sheets

EASY ACCESS REFUSE CONTAINER

BACKGROUND OF INVENTION

1. Field of Invention

The present invention relates to a refuse container, and more particularly to a container that facilitates the removal of trash from the refuse container.

2. Relevant Background

When utilizing a refuse container with a trash liner contained within it, a person must lift the trash liner above the container, which lends itself to strain on the person lifting, and the potential for the trash liner to rip or tear due to the stress put on the trash liner while being lifted, thus releasing unwanted trash outside of the trash liner and perhaps onto the person lifting the trash liner. Many times, the trash liner adheres to the sidewalls of the refuse container making it difficult to lift the trash liner out of the refuse container. When this occurs, a person may need to lift the trash liner while holding down the refuse container with his or her legs, or another person may need to hold the refuse container while the trash liner is lifted up. Often, the trash liner will be removed from the refuse container before it is completely filled in order to avoid trash liner breakage and strain, thus failing to utilize the trash liner to its fullest capacity.

Similar problems exist when emptying a refuse container without a trash liner. In this instance, the entire refuse container must be turned upside down to empty it.

Additionally, it is sometimes difficult to clean a refuse container because it is often hard to reach the bottom of the refuse container.

It is therefore desirable to provide an improved container which overcomes most, if not all, of the preceding problems.

SUMMARY

The present invention is directed to a refuse container that satisfies these needs. Operationally, when emptying the contents, the trash liner is unattached from the upper wall sections, then the upper wall sections are opened thus permitting easy access to the trash liner and allowing its removal by simply lifting the trash liner above the lower side walls.

The present invention comprises: (i) a lower member that comprises a bottom portion, lower side walls that are coupled to a perimeter of the bottom portion, the lower side walls defining a substantially vertical axis that extends upwardly from the bottom portion, and wall edges at an upper end of the lower side walls form a lower wall rim, (ii) upper wall sections comprising a first upper wall section and a second upper wall section, the upper wall sections each having a vertical hinged edge on a first side and a vertical seamed edge on a second, opposite side, (iii) wall edges at an upper end of the upper wall sections form an upper wall rim that defines an open top, (iv) a hinge for pivotally mounting the first upper wall section and the second upper wall section at the vertical hinged edges such that the first upper wall section and the second upper wall section are moveable in a first direction toward an open position and in a second, opposite direction toward a closed position, (v) at least one section fastener for securing the first upper wall section and the second upper wall section in a closed position, and (vi) a wall securing device providing support for coupling the upper wall sections to the lower side walls.

In one embodiment, the wall securing device comprises: (i) an annular wall recess along an outer surface of the lower side walls, the annular wall recess forming a lower side wall concave groove, (ii) a first annular section protrusion along an inner surface of the first upper wall section, (iii) a second annular section protrusion along an inner surface of the second upper wall section, the second annular section protrusion being positioned symmetrically with the first annular section protrusion, and (iv) the first annular section protrusion and the second annular section protrusion have a shape and size that is the same as each other, and that is complementary to a shape and size of the annular wall recess such that the annular wall recess is capable of receiving the first annular section protrusion when the first upper wall section is closed, and capable of receiving the second annular section protrusion when the second upper wall section is closed, thereby providing coupling support between the lower side walls and the upper wall sections.

In another embodiment, the wall securing device comprises: (i) an annular wall protrusion along an outer surface of the lower side walls, (ii) a first annular section recess along an inner surface of the first upper wall section, the first annular section recess forming a first section concave groove, (iii) a second annular section recess along an inner surface of the second upper wall section, the second annular section recess forming a second section concave groove, and (iv) the first annular section recess and the second annular section recess having a shape and size that is the same as each other, and that is complementary to a shape and size of the annular wall protrusion such that the first annular section recess and the second annular section recess are capable of receiving the annular wall protrusion when in closed positions, thus providing coupling support between the lower side walls and the first upper wall section, and between the lower side walls and the second upper wall section.

In one embodiment, the hinge comprises: (i) a plurality of first aligned section hinge knuckles coupled to the vertical hinged edge of the first upper wall section, the first aligned section hinge knuckles being substantially tubular in shape, (ii) a plurality of second aligned section hinge knuckles coupled to the vertical hinged edge of the second upper wall section, the second aligned section hinge knuckles being substantially tubular in shape, the first aligned section hinge knuckles and the second aligned section hinge knuckles fitting end-to-end between, and in axial alignment with, each other, (iii) a rigid pivot mounting rod extending vertically along an inside of the first aligned section hinge knuckles and along an inside of the second aligned section hinge knuckles thus coupling the rigid pivot mounting rod with the upper wall sections the rigid pivot mounting rod being slidably supported by the first aligned section hinge knuckles and the second aligned section hinge knuckles, and (iv) a rod fastener that couples the rigid pivot mounting rod to the lower side walls thereby providing support to prevent the lower side walls from disengaging from the upper walls sections. The rod fastener may comprise a single rod receiving element coupled to the lower side walls, the single rod receiving element comprising (i) a single vertically oriented opening that has a size and shape that is complementary to the rigid pivot mounting rod such that the single vertically oriented opening is capable of receiving the rigid pivot mounting rod, (ii) a single pin entry hole on a first side, and a single pin exit hole on a second, opposing side, (ii) a rod cavity extending through the rigid pivot mounting rod and (iii) a single cotter pin that extends transversely through the single pin entry hole, through the rod cavity, and through the single pin exit hole thereby coupling the rigid pivot mounting rod to the lower side walls and providing support to prevent the lower side walls from disengaging from the upper walls sections.

Generally, the hinge comprises vertically oriented interleaving knuckles, and a rigid pivot mounting rod extending vertically along an inside of the knuckles, the rigid pivot mounting rod slidably supported by the knuckles. However, in other embodiments, the hinge may be any flexible device that allows the upper wall sections to be pivotably opened and closed.

In one embodiment, the section fastener comprises a first cooperating wall latch member that is coupled to an outer portion of the first upper wall section, and a second cooperating wall latch member that is coupled to an outer portion of the second upper wall section. The second cooperating wall latch member being capable of releasably attaching to the first cooperating wall latch member thereby securing the upper wall sections together in a closed position.

In one embodiment, the first upper wall section and the second upper wall section have a shape that is substantially similar to a shape of the lower side walls. In one embodiment, the lower side walls are cylindrical in shape. In other embodiments, the lower side walls have a shape that is other than cylindrical.

In one embodiment, the first upper wall section and the second upper wall section have a shape that is substantially similar to a shape of the lower side walls, and the upper wall sections and the lower side walls are tapered such that a circumference of the upper wall rim is larger than a circumference of the bottom portion. In another embodiment, the first upper wall section and the second upper wall section have a shape that is substantially similar to a shape of the lower side walls, and a circumference of the upper wall rim is the same as a circumference of the bottom portion.

In one embodiment, the present invention further comprises an optional top lid that is releasably attachable to the upper wall rim such that the top lid protects against intrusion by animals and contains odor when attached.

In one embodiment, the top lid has at least one top lid handle for removably attaching the top lid to the upper wall sections.

In one embodiment, the upper wall sections have at least one upper wall handle to aid in gripping and to facilitate dragging, lifting, pushing and pulling.

In an alternative embodiment, a wheel assembly is coupled to an underside of the bottom portion thereby facilitating movement by allowing the present invention to be rolled, and a tilt handle is coupled to the top lid to facilitate tilting and rolling the container on the wheel assembly.

In an alternative embodiment, the hinge comprises: (i) a spine wall coupled to a portion of the lower side walls and extending upwardly therefrom to align with the upper wall rim, vertical edges of the spine wall forming a first spine side on a first side and a second spine side on a second, opposing side, (ii) a plurality of first aligned spine hinge knuckles coupled to, and extending outwardly from, the first spine side, the first aligned spine hinge knuckles being substantially tubular in shape, (iii) a plurality of second aligned spine hinge knuckles coupled to, and extending outwardly from, the second spine side, the second aligned spine hinge knuckles being substantially tubular in shape, (iv) a plurality of first aligned section hinge knuckles coupled to the vertical hinged edge of the first upper wall section, the first aligned section hinge knuckles being substantially tubular in shape, the first aligned section hinge knuckles fitting end-to-end between, and in axial alignment with, the first aligned spine hinge knuckles, (v) a plurality of second aligned section hinge knuckles coupled to the vertical hinged edge of the second upper wall section, the second aligned section hinge knuckles being substantially tubular in shape, the second aligned section hinge knuckles fitting end-to-end between, and in axial alignment, with the second aligned spine hinge knuckles, (vi) a first rigid pivot mounting rod extending vertically along an inside of the first aligned spine hinge knuckles and the first aligned section hinge knuckles, the first rigid pivot mounting rod slidably supported by the first aligned spine hinge knuckles and the first aligned section hinge knuckles, (vii) a first rod fastener that couples the first rigid pivot mounting rod to the lower side walls thereby providing support to prevent the lower side walls from disengaging from the upper walls sections, (viii) a second rigid pivot mounting rod extending vertically along an inside of the second aligned spine hinge knuckles and the second aligned section hinge knuckles, the second rigid pivot mounting rod slidably supported by the second aligned spine hinge knuckles and the second aligned section hinge knuckles, and (ix) a second rod fastener that couples the second rigid pivot mounting rod to the lower side walls thereby providing support to prevent the lower side walls from disengaging from the upper walls sections.

The first rod fastener may comprise a first rod receiving element coupled to the lower side walls, the first rod receiving element comprising (i) a first vertically oriented opening that has a size and shape that is complementary to the first rigid pivot mounting rod such that the first vertically oriented opening is capable of receiving the first rigid pivot mounting rod, (ii) a first pin entry hole on a first side, and a first pin exit hole on a second, opposing side, (ii) a first rod cavity extending through the first rigid pivot mounting rod, and (iii) a first cotter pin that extends transversely through the first pin entry hole, through the first rod cavity, and through the first pin exit hole thereby coupling the first rigid pivot mounting rod to the lower side walls and providing support to prevent the lower side walls from disengaging from the upper walls sections.

The second rod fastener may comprise a second rod receiving element coupled to the lower side walls, the second rod receiving element comprising (i) a second vertically oriented opening that has a size and shape that is complementary to the second rigid pivot mounting rod such that the second vertically oriented opening is capable of receiving the second rigid pivot mounting rod, (ii) a second pin entry hole on a first side, and a second pin exit hole on a second, opposing side, (ii) a second rod cavity extending through the second rigid pivot mounting rod, and (iii) a second cotter pin that extends transversely through the second pin entry hole, through the second rod cavity, and through the second pin exit hole thereby coupling the second rigid pivot mounting rod to the lower side walls and providing support to prevent the lower side walls from disengaging from the upper walls sections.

A method of the present invention is also presented. In one embodiment, the method comprises (i) providing a lower member comprising a bottom portion coupled to lower side walls, providing an upper wall, wherein the upper wall has multiple sections, each section being vertically mounted at a hinged edge such that the sections are moveable in a first direction toward an open position and in a second, opposite direction toward a closed position, (ii) using a section fastener for securing the sections to each other in a closed position, and (iii) using a wall securing device to provide support for coupling the upper wall sections to the lower side walls.

REFERENCE NUMBERS IN THE DRAWINGS

| # | |
|---|---|
| 18 | Substantially vertical axis |
| 20 | Lower member |

-continued

| # | |
|---|---|
| 22 | Bottom portion |
| 24 | Lower side walls |
| 25 | Lower wall rim |
| 26 | Upper wall sections |
| 28 | First upper wall section |
| 30 | Second upper wall section |
| 32 | Vertical hinged edge |
| 34 | Vertical seamed edge |
| 36 | Upper wall rim |
| 40 | Hinge |
| 42 | First aligned section hinge knuckles |
| 44 | Second aligned section hinge knuckles |
| 46 | Rigid pivot mounting rod |
| 48 | Rod cavity |
| 50 | Spine wall |
| 52 | Bolts |
| 54 | First spine side |
| 56 | Second spine side |
| 58 | First aligned spine hinge knuckles |
| 60 | Second aligned spine hinge knuckles |
| 61 | First rigid pivot mounting rod |
| 62 | Second rigid pivot mounting rod |
| 63 | First rod fastener |
| 64 | Second rod fastener |
| 68 | First aligned section hinge knuckles |
| 69 | Second aligned section hinge knuckles |
| 70 | Annular wall recess |
| 72 | First annular section protrusion |
| 74 | Second annular section protrusion |
| 76 | First annular section recess |
| 78 | Second annular section recess |
| 80 | Annular wall protrusion |
| 82 | Section fastener |
| 83 | First cooperating wall latch member |
| 84 | Second cooperating wall latch member |
| 86 | Top lid |
| 87 | Top lid handle |
| 88 | Tilt handle |
| 90 | Rod fastener |
| 94 | Wheel assembly |
| 96 | Bottom portion indentation |
| 98 | First rod cavity |
| 99 | Second rod cavity |
| 100 | First cooperating lid latch member |
| 102 | Second cooperating lid latch member |
| 103 | Upper wall rim protrusion |
| 106 | Upper wall handle |
| 110 | Single rod receiving element |
| 111 | Single vertically oriented opening |
| 112 | Single cotter pin |
| 114 | Single pin entry hole |
| 116 | Single pin exit hole |
| 120 | First rod receiving element |
| 121 | First vertically oriented opening |
| 122 | First cotter pin |
| 124 | First pin entry hole |
| 126 | First pin exit hole |
| 130 | Second rod receiving element |
| 131 | Second vertically oriented opening |
| 132 | Second cotter pin |
| 134 | Second pin entry hole |
| 136 | Second pin exit hole |

Figure 1:
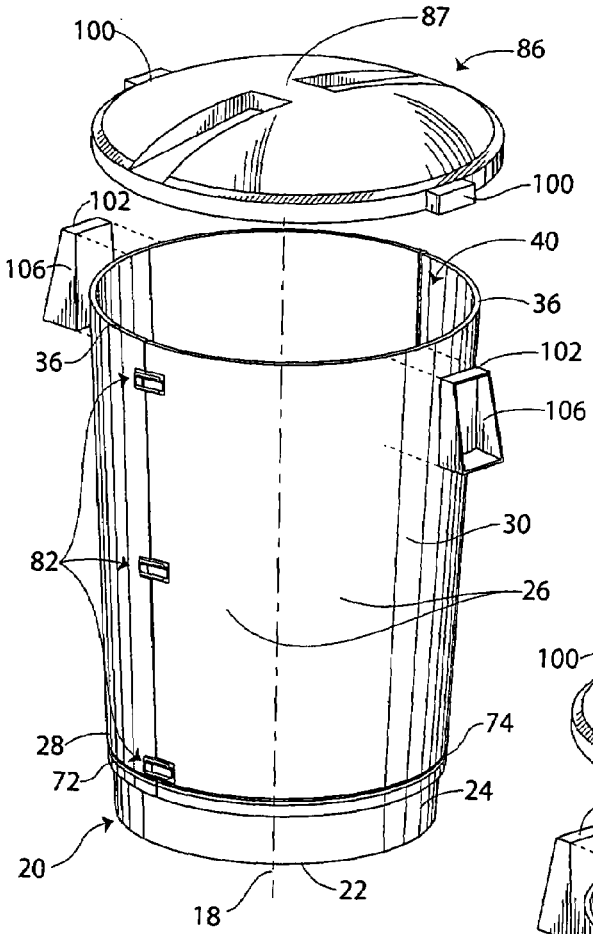
FIG. 1 is a front perspective view of the trash receptacle with a single hinge in accordance with one embodiment of the present invention.

It is to be understood that the present invention is not limited in its application to the details of the construction and arrangement of parts illustrated in the accompanying drawing, since the invention is capable of other embodiments and of being practiced or carried out in various ways within the scope of the present invention. For example, a plurality of materials of construction may be employed, both currently known or that later become known. It is to be understood that the present invention includes construction utilizing metric measurements. Also, it is also to be understood that the phraseology and terminology employed herein is for the purpose of description, and not of limitation.

DETAILED DESCRIPTION

As shown in FIG. 1 through FIG. 11, a refuse container comprises a lower member 20 that comprises a bottom portion 22 and lower side walls 24 that are coupled to a perimeter of the bottom portion 22, upper wall sections 26 comprising a first upper wall section 28 and a second upper wall section 30, a hinge 40 for pivotally mounting the first upper wall section 28 and the second upper wall section 30, at least one section fastener 82 for securing the first upper wall section 28 to the second upper wall section 30 when in a closed position, and a wall securing device for providing support for coupling the upper wall sections 26 to the lower side walls 24.

FIGS. 1 through 4 show the preferred embodiment. The lower side walls 24 define a substantially vertical axis 18 extending upwardly from the bottom portion 22. Wall edges at an upper end of the lower side walls 24 form a lower wall rim 25. Wall edges at an upper end of the upper wall sections 26 form an upper wall rim 36 that defines an open top. The first upper wall section 28 and the second upper wall section 30 may have a shape that is substantially similar to a shape of the lower side walls 24. In the preferred embodiment, the lower side walls 24 and upper wall sections 26 are tapered such that a circumference of the upper wall rim 36 is larger than a circumference of the bottom portion 22. In an alternative embodiment the lower side walls 24 and upper wall sections 26 are vertical such that a circumference of the upper wall rim 36 is the same as a circumference of the bottom portion 22. In the preferred embodiment, the bottom portion 22 is circular in shape. In alternative embodiments, the bottom portion 22 may be any conventional geometric shape including without limitation rectangular, square, octagonal, and hexagonal. In the preferred embodiment, the bottom portion 22 is made of plastic. In alternative embodiments, the bottom portion 22 may be made of any other material sufficient to serve its purpose of supporting a trash liner including without limitation metal.

The diameter of the bottom portion 22 may be about 45 cm (approximately 18 inches). In the preferred embodiment, the bottom portion 22 is molded with the lower side walls 24. The lower side walls 24 may extend upwardly about 18 cm (approximately 7 inches). The bottom portion 22 and the lower side walls 24 provide an area for retaining liquid and solid materials that may have spilled and leaked through the trash liner.

Figure 3:
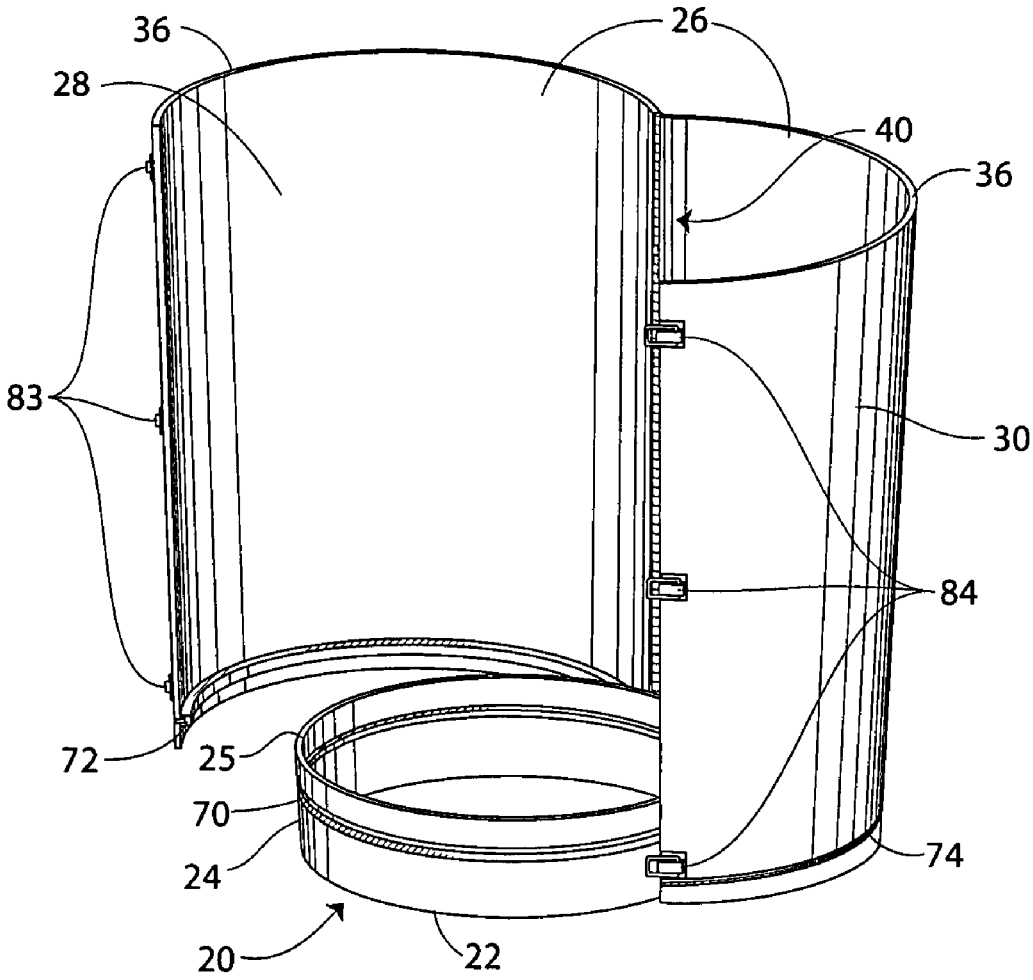
FIG. 3 is a perspective view of the trash receptacle with a single hinge and wall members in an open position in accordance with one embodiment of the present invention.
Figure 4:
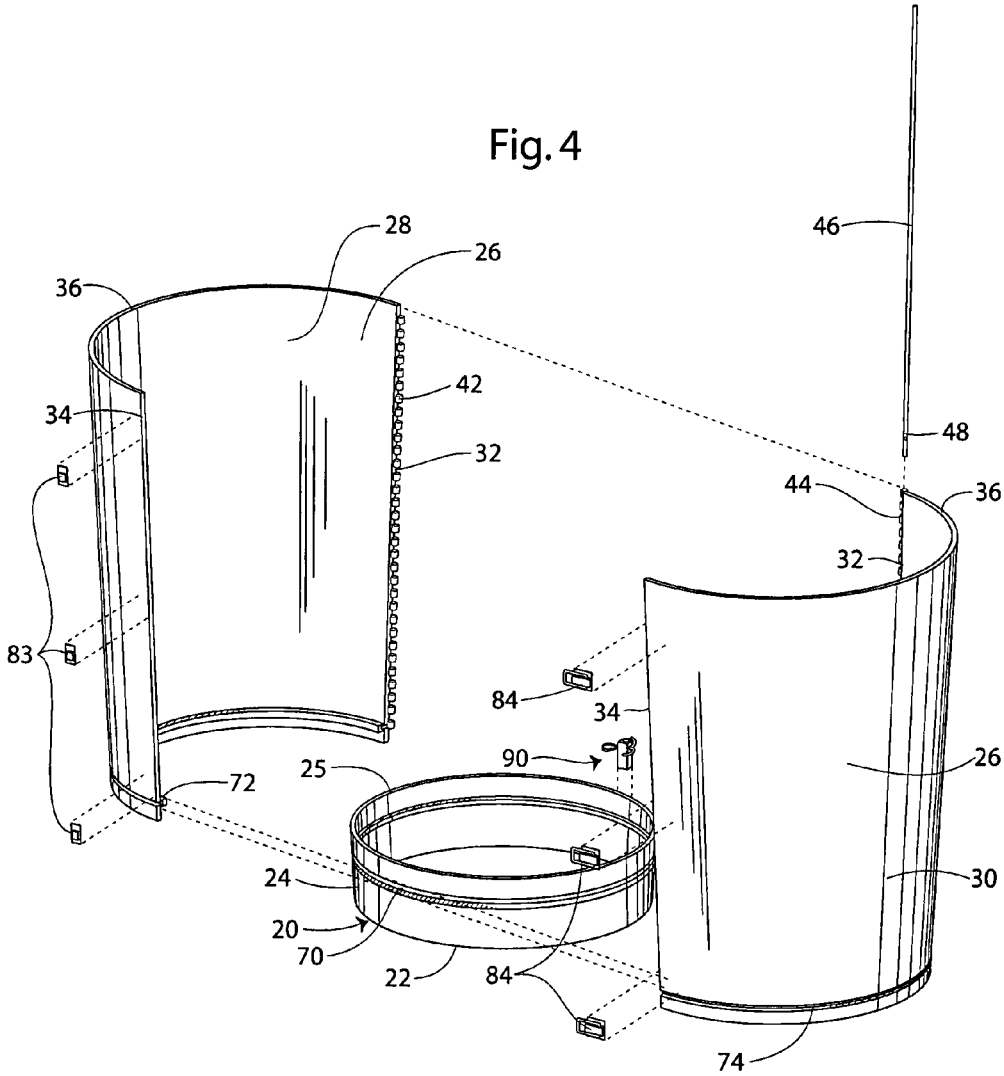
FIG. 4 is a perspective exploded view of the trash receptacle of FIG. 1.

In the preferred embodiment, as best shown in FIG. 3 and FIG. 4, the wall securing device comprises an annular wall recess 70 along an outer surface of the lower side walls 24 forming a lower side wall concave groove, a first annular section protrusion 72 along an inner surface of the first upper wall section 28, and a second annular section protrusion 74 along an inner surface of the second upper wall section 30. The second annular section protrusion 74 may be positioned symmetrically with the first annular section protrusion 72. A lower edge of the annular wall recess 70 may be about 13 cm (approximately 5 inches) from the bottom portion 22, and an upper edge of the annular wall recess 70 may be about 15.5 cm (approximately 6 inches) from the bottom portion 22. The first annular section protrusion 72 and the second annular section protrusion 74 may each have a shape and size that is the same as each other, and that is complementary to a shape and size of, the annular wall recess 70 such that the annular wall recess 70 is capable of receiving the first annular section protrusion 72 when the first upper wall section 28 is closed, and capable of receiving the second annular section protrusion 74 when the second upper wall section 30 is closed, thereby providing coupling support between the lower side walls 24 and the upper wall sections 26. In the preferred embodiment, the upper wall sections 26 extend downwardly about 15.5 cm (approximately 6 inches) below the lower edge of the annular wall recess 70. In an alternative embodiment, the lower peripheral edge of the upper wall sections 26 extends to the bottom portion 22. In other alternative embodiments, the upper wall sections 26 extend less than about 15.5 cm (approximately 6 inches) beyond the lower edge of the annular wall recess 70.

Figure 5:
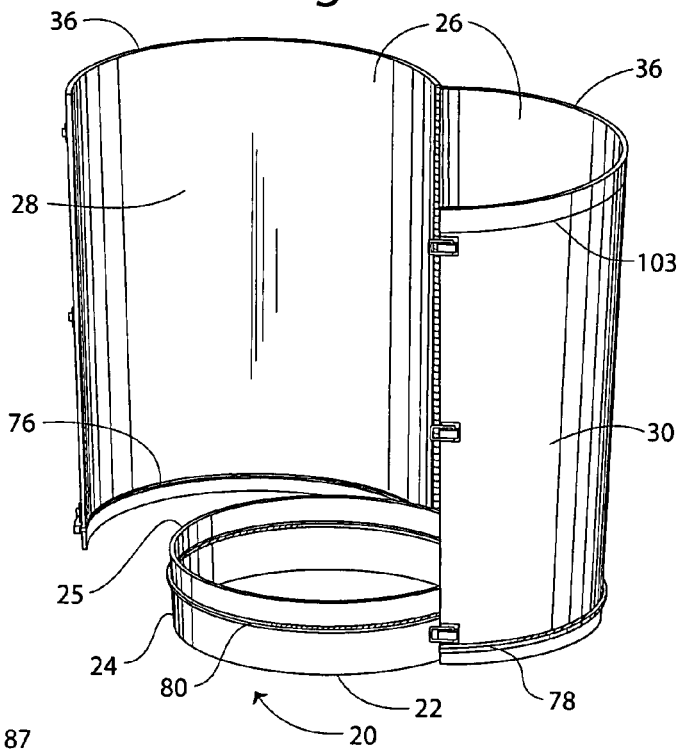
FIG. 5 is a perspective view of the trash receptacle with the lower member having a protrusion and the upper wall sections having a recess in accordance with an alternative embodiment of the present invention.

In an alternative embodiment, best shown in FIG. 5, the wall securing device comprises an annular wall protrusion 80 along an outer surface of the lower side walls 24, a first annular section recess 76 along an inner surface of the first upper wall section 28 forming a first section concave groove, and a second annular section recess 78 along an inner surface of the second upper wall section 30 forming a second section concave groove. The second annular section recess 78 may be positioned symmetrically with the first annular section recess 76. A lower edge of the annular wall protrusion 80 may be about 13 cm (approximately 5 inches) from the bottom portion 22, and an upper edge of the annular wall protrusion 80 may be about 15.5 cm (approximately 6 inches) from the bottom portion 22. The first annular section recess 76 and the second annular section recess 78 may each have a shape and size that is the same as each other, and that is complementary to a shape and size of the annular wall protrusion 80 such that the first annular section recess 76 and the second annular section recess 78 are capable of receiving the annular wall protrusion 80 thus securing the upper wall sections 26 to the lower side walls 24 when the upper wall sections 26 are in a closed position.

In the preferred embodiment, and as best shown in FIG. 4, the upper wall sections 26 each have a vertical hinged edge 32 on a first side and a vertical seamed edge 34 on a second, opposite side.

In the preferred embodiment, as best shown in FIGS. 3 and 4, the hinge 40 comprises a plurality of first aligned section hinge knuckles 42 coupled to the vertical hinged edge 32 of the first upper wall section 28, a plurality of second aligned section hinge knuckles 44 coupled with the vertical hinged edge 32 of the second upper wall section 30, and a rigid pivot mounting rod 46. The first aligned section hinge knuckles 42 and the second aligned section hinge knuckles 44 may be substantially tubular in shape, and may fit end-to-end between, and in axial alignment with, each other. In the preferred embodiment, the first aligned section hinge knuckles 42 and the second aligned section hinge knuckles 44 are integrally molded to the vertical hinged edges 32. In alternative embodiments, the first aligned section hinge knuckles 42 and the second aligned section hinge knuckles 44 may be formed by any means including without limitation bent flange elements.

In the preferred embodiment, and as shown in FIG. 4, the rigid pivot mounting rod 46 extends vertically along an inside of the first aligned section hinge knuckles 42 and an inside of the second aligned section hinge knuckles 44 thus coupling the rigid pivot mounting rod 46 with the upper wall sections 26. The rigid pivot mounting rod 46 may be slidably supported by the first aligned section hinge knuckles 42 and the second aligned section hinge knuckles 44 thus allowing the first upper wall section 28 and the second upper wall section 30 to be moveable in a first direction toward an open position and in a second, opposite direction toward a closed position. In other embodiments, the hinge may be any flexible device that allows the upper wall sections to be pivotably opened and closed.

Figure 2:
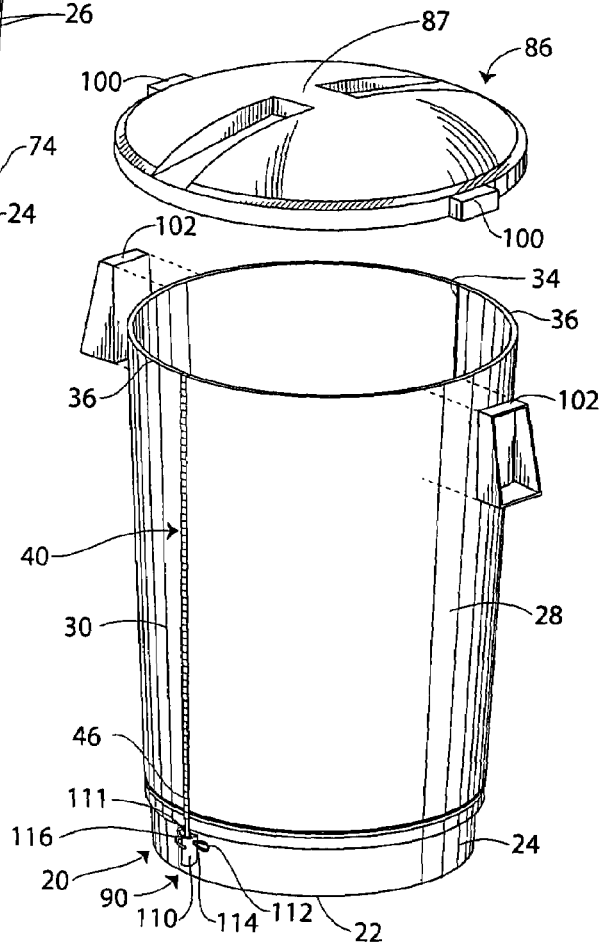
FIG. 2 is a rear perspective view of the trash receptacle of FIG. 1.

As best shown in FIG. 2, a rod fastener 90 couples the rigid pivot mounting rod 46 to the lower side walls 24 thereby providing support to prevent the lower side walls 24 from disengaging from the upper walls sections 26. In the preferred embodiment, the rod fastener 90 comprises a single rod receiving element 110 coupled to the lower side walls 24, a rod cavity 48 in the rigid pivot mounting rod 46, and a single cotter pin 112. The single rod receiving element 110 may comprise a single vertically oriented opening 111 having a size and shape that is complementary to the rigid pivot mounting rod 46 such that the single vertically oriented opening 111 is capable of receiving the rigid pivot mounting rod 46. The single rod receiving element 110 may have a single pin entry hole 114 on a first side and a single pin exit hole 116 on a second, opposing side. In the preferred embodiment, the single cotter pin 112 extends transversely through the single pin entry hole 114, through the rod cavity 48, and through the single pin exit hole 116. In alternative embodiments, the rod fastener 90 may be any device capable of securing the rigid pivot mounting rod 46 to the lower side walls 24 including without limitation a nut and bolt. One skilled in the art will recognize that there are various rod fastener configurations available.

In the preferred embodiment, as shown in FIGS. 1 and 3, the section fastener 82 comprises a first cooperating wall latch member 83 that is coupled to an outer portion of the first upper wall section 28 and a second cooperating wall latch member 84 that is coupled to an outer portion of the second upper wall section 30. The second cooperating wall latch member 84 may be releasably attached to the first cooperating wall latch member 83 thereby securing the upper wall sections 26 one to the other in a closed position. In the preferred embodiment, the first cooperating wall latch member 83 is a keeper and the second cooperating wall latch member 84 is a draw latch wherein the draw latch mates with the keeper. It is to be understood that the section fastener 82 may be any cooperating components capable of serving their intended purpose of holding the upper wall sections 26 together such as without limitation Velcro strips, a lever-actuated fastener, a turn-operated fastener, a slide-action fastener, a push-pull fastener, a lift-and-turn fastener, magnetic catches, and spring-loaded devices.

In the preferred embodiment, and as shown in FIG. 1, upper wall sections 26 may have at least one upper wall handle 106 to aid in gripping the container to facilitate moving by dragging, lifting, pushing and pulling. One skilled in the art will recognize that there are various handle configurations available.

Figure 6:
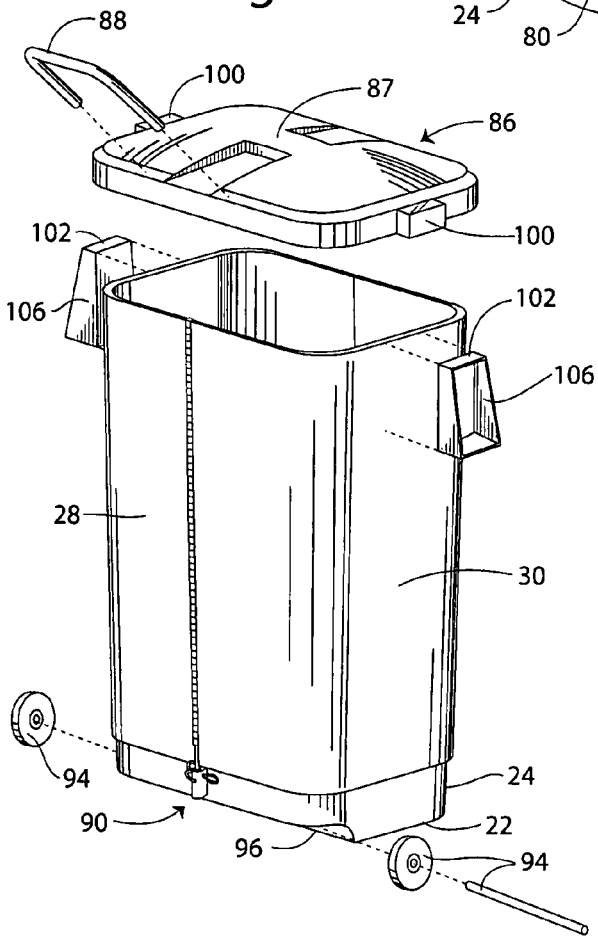
FIG. 6 is a perspective view of the trash receptacle having a square shape in accordance with an alternative embodiment of the present invention.
Figure 7:
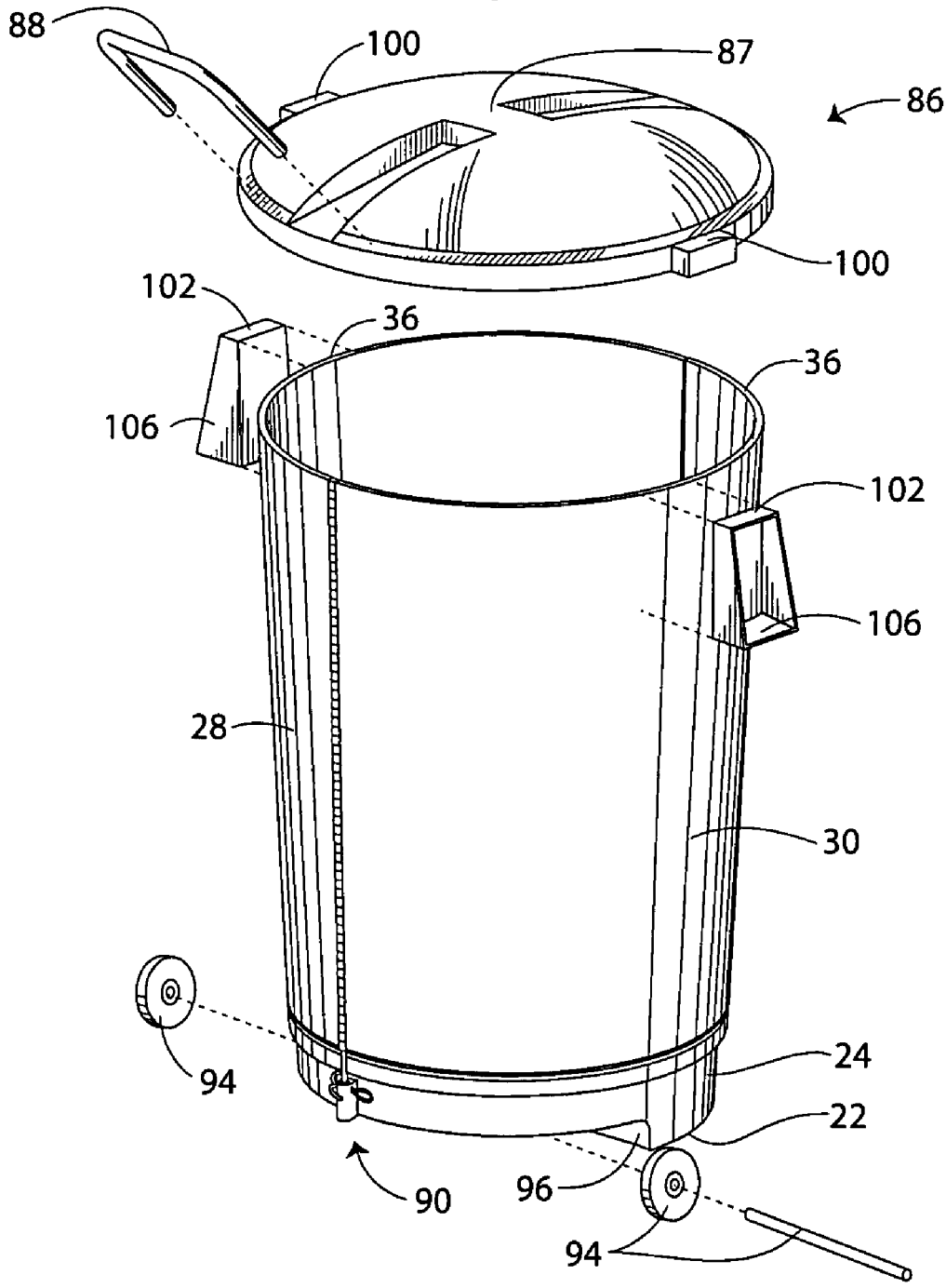
FIG. 7 is a perspective view of the trash receptacle with a wheel assembly in accordance with an alternative embodiment of the present invention.
Figure 8:
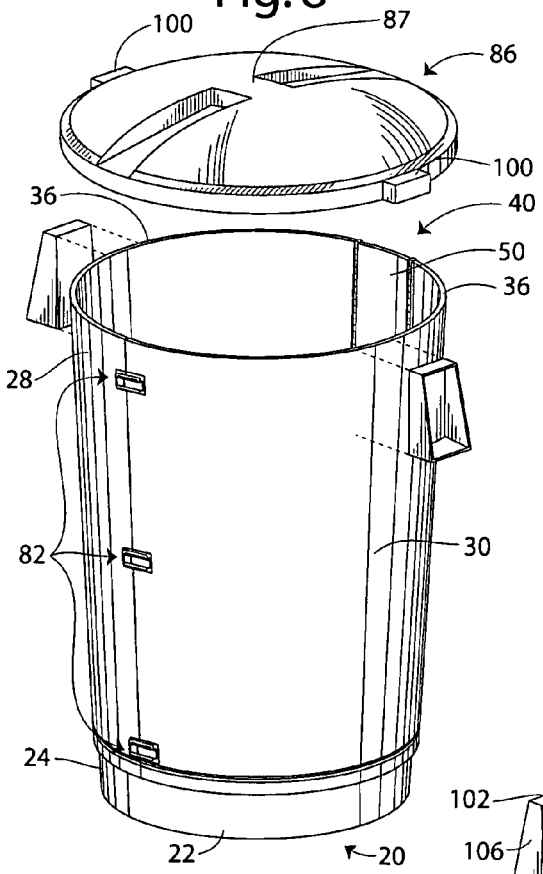
FIG. 8 is a front perspective view of the trash receptacle with an attached spine in accordance with an alternative embodiment of the present invention.

In the preferred embodiment, the bottom portion 22 is flat and meets with a floor surface. FIGS. 6 and 7 show alternative embodiments having an optional wheel assembly 94 coupled to an underside of the bottom portion 22 to facilitate movement by allowing the present invention to be rolled. The underside of the bottom portion 22 may have a bottom portion indentation 96 to allow space for the wheel assembly 94. One skilled in the art will recognize that there are various wheel configurations available.

In the preferred embodiment, as shown in FIGS. 1 and 2, the present invention may optionally comprise a top lid 86 that is coupled to the upper wall rim 36 such that the top lid 86 secures to the upper wall sections 26 thereby containing odor and protecting trash within from intrusion by animals. The top lid 86 may have a shape and size that is complementary to a shape and size of the upper wall sections 26 when in a closed position. The top lid 86 may have at least one top lid handle 87 for gripping and removably attaching the top lid 86 to the upper wall sections 26. In the preferred embodiment, the top lid handle 87 is molded to the top lid 86. In alternative embodiments, the top lid handle 87 may be any device or attachment that is capable of accomplishing its intended purpose.

FIGS. 6 and 7 show alternative embodiments having a tilt handle 88 coupled to the top lid 86 to facilitate tilting and rolling the container when the wheel assembly 94 is attached.

In the preferred embodiment, referring back to FIGS. 1 and 2, the top lid 86 is secured to the upper wall sections 26 by a first cooperating lid latch member 100 coupled to the top lid 86, and a second cooperating lid latch member 102 coupled to an outer portion of the upper wall sections 26 wherein the top lid 86 holds to the upper wall sections 26 when the first cooperating lid latch member 100 engages with the second cooperating lid latch member 102 and the upper wall sections 26 are in a closed position. In alternative embodiments, an upper wall rim protrusion 103, as shown in FIG. 5, may extend transversely at the upper wall rim 36 and be complementary to an inner perimeter of the top lid 86 such that the top lid 86 snaps over the upper wall rim protrusion 103 thus securing the top lid 86 to the upper wall rim 36. In other embodiments, the top lid 86 may be secured by any attachment devices including without limitation tongues and grooves, clips, and strips. One skilled in the art will recognize that there are various configurations for securing the top lid 86 to the upper wall sections 26.

FIG. 6 illustrates an alternative embodiment with a square shape, the bottom portion indentation 96, the wheel assembly 94, and the top lid 86 with the top lid handle 87 and the tilt handle 88.

FIG. 7 illustrates an alternative embodiment of the present invention with a circular shape, the bottom portion indentation 96, the wheel assembly 94, and the top lid 86 with the top lid handle 87 and the tilt handle 88.

FIG. 8 through FIG. 11 show an alternative embodiment of the present invention wherein the hinge 40 comprises (i) a spine wall 50 coupled to a portion of the lower side walls 24, vertical edges of the spine wall 50 forming a first spine side 54 on a first side and a second spine side 56 on a second, opposing side, (ii) a plurality of first aligned spine hinge knuckles 58 coupled to, and extending outwardly from, the first spine side 54, (iii) a plurality of second aligned spine hinge knuckles 60 coupled to, and extending outwardly from, the second spine side 56, (iv) a plurality of first aligned section hinge knuckles 68 coupled to the vertical hinged edge 32 of the first upper wall section 28, (v) a plurality of second aligned section hinge knuckles 69 coupled to the vertical hinged edge 32 of the second upper wall section 30, (vi) a first rigid pivot mounting rod 61 and (vii) a second rigid pivot mounting rod 62.

The spine wall 50 may have a width of about 13 cm (approximately 5 inches) and extend upwardly to align with the upper wall rim 36. The spine wall 50 may be permanently attached and molded to the lower side walls 24. In an alternative embodiment, the spine wall 50 extends downwardly below the lower wall rim 25 and is attached to the lower side walls 24 by nuts and bolts 52. In other embodiments, the spine wall 50 may be attached to the lower side walls 24 by any means capable of holding the spine wall 50 and the lower side walls 24 together.

The first aligned spine hinge knuckles 58 may be integrally molded to the first spine side 54, and the second aligned spine hinge knuckles 60 may be integrally molded to the second spine side 56. In alternative embodiments, the first aligned spine hinge knuckles 58 and the second aligned spine hinge knuckles 60 may be formed by any means including without limitation bent flange elements.

Figure 11:
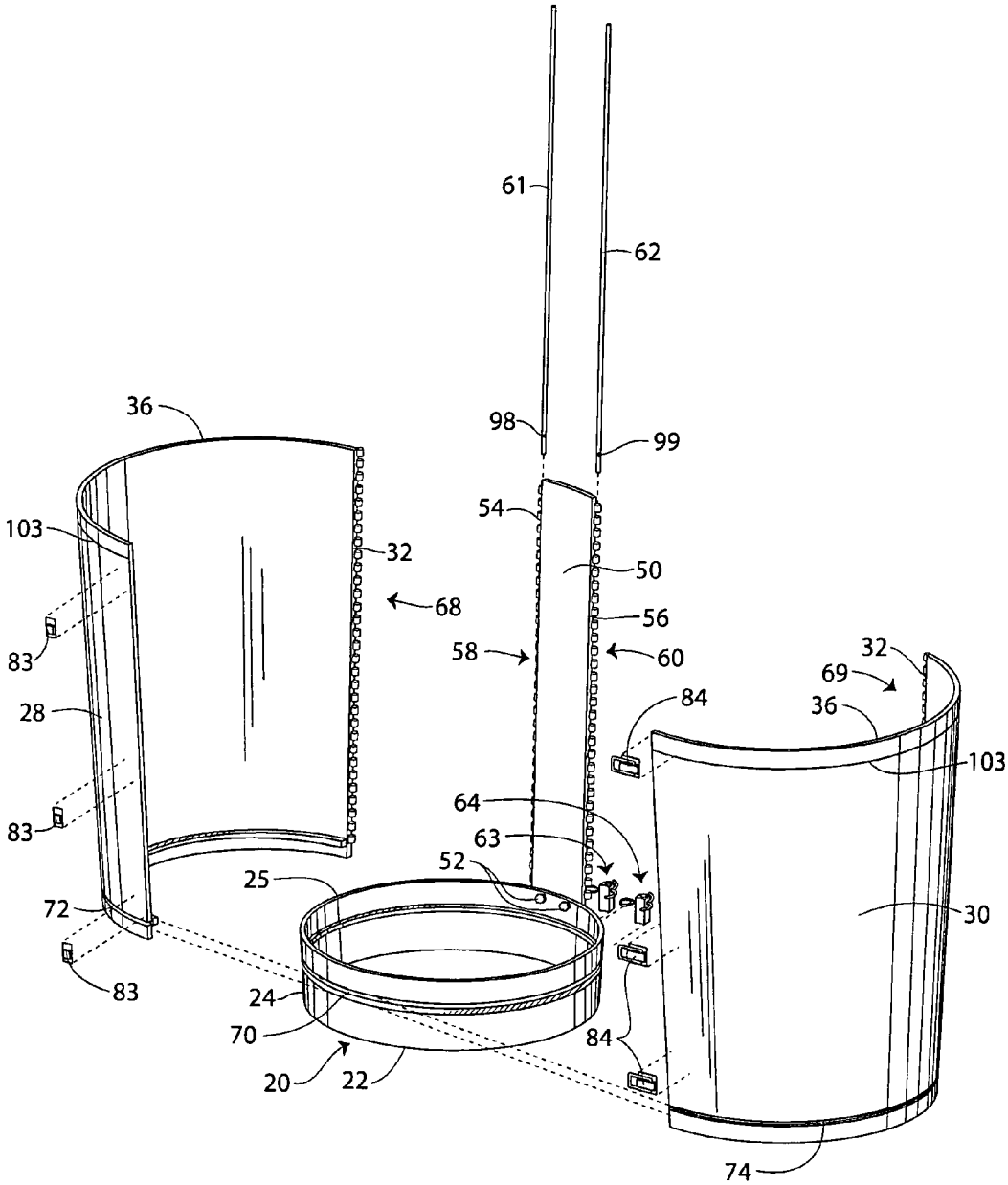
FIG. 11 is a perspective exploded view of the trash receptacle of FIG. 10.

As best shown in FIG. 11, the first aligned spine hinge knuckles 58, the second aligned spine hinge knuckles 60, first aligned section hinge knuckles 68 and the second aligned section hinge knuckles 69 may be substantially tubular in shape. The first aligned section hinge knuckles 68 may be capable of fitting end-to-end between, and in axial alignment with, the first aligned spine hinge knuckles 58. The second aligned section hinge knuckles 69 may be capable of fitting end-to-end between, and in axial alignment with, the second aligned spine hinge knuckles 60.

As best shown in FIG. 11, a first rigid pivot mounting rod 61 extends vertically along an inside of the first aligned spine hinge knuckles 58 and the first aligned section hinge knuckles 68. A second rigid pivot mounting rod 62 extends vertically along an inside of the second aligned spine hinge knuckles 60 and the second aligned section hinge knuckles 69.

Figure 9:
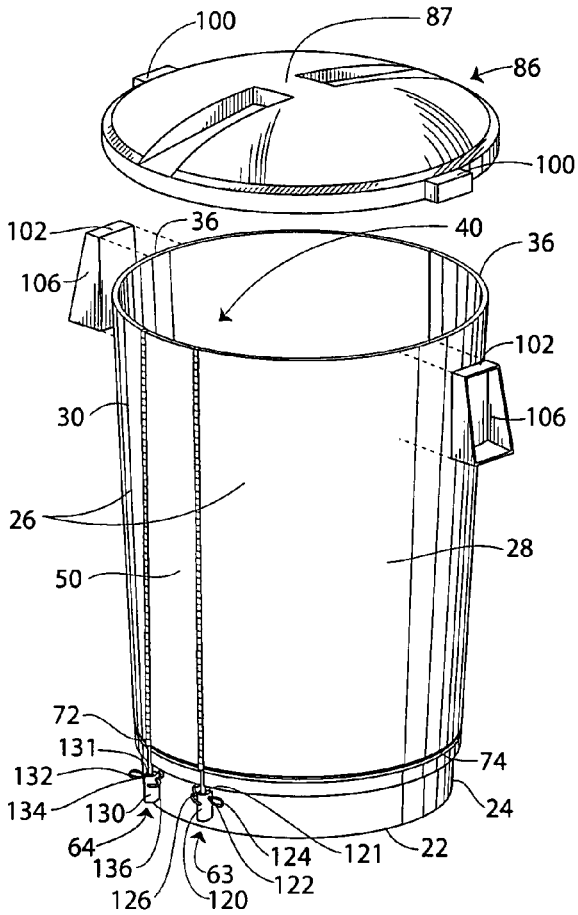
FIG. 9 is a rear perspective view of the trash receptacle of FIG. 8.
Figure 10:
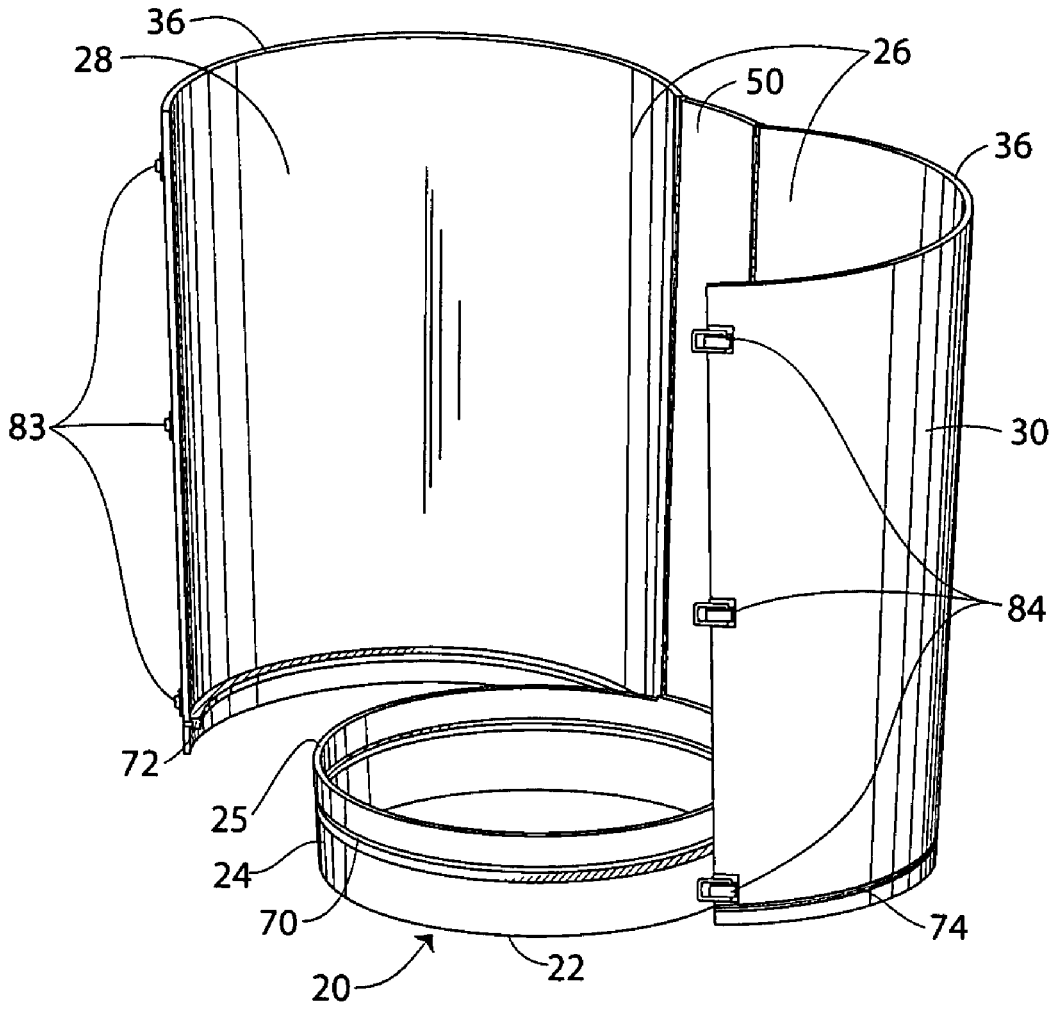
FIG. 10 is a perspective view of the trash receptacle with an attached spine and wall members in an open position in accordance with an alternative embodiment of the present invention.

As best shown in FIG. 9, a first rod fastener 63 may secure the first rigid pivot mounting rod 61, and a second rod fastener 64 may secure the second rigid pivot mounting rod 62, thereby preventing the lower side walls 24 from disengaging when upward force is exerted on the upper wall sections 26. The first rod fastener 63 may comprise a first rod receiving element 120 coupled to the lower side walls 24, a first rod cavity 98 in the first rigid pivot mounting rod 61, and a first cotter pin 122. The first rod receiving element 120 may comprise a first vertically oriented opening 121 having a size and shape that is complementary to the first rigid pivot mounting rod 61 such that the first vertically oriented opening 121 is capable of receiving the first rigid pivot mounting rod 61. The first rod receiving element 120 may have a first pin entry hole 124 on a first side and a first pin exit hole 126 on a second, opposing side. In the preferred embodiment, the first cotter pin 122 extends transversely through the first pin entry hole 124, through the first rod cavity 98, and through the first pin exit hole 126, thereby securely coupling the first rigid pivot mounting rod 61 to the lower side walls 24.

The second rod fastener 64 may comprise a second rod receiving element 130 coupled to the lower side walls 24, a second rod cavity 99 in the second rigid pivot mounting rod 62, and a second cotter pin 132. The second rod receiving element 130 may comprise a second vertically oriented opening 131 having a size and shape that is complementary to the second rigid pivot mounting rod 62 such that the second vertically oriented opening 131 is capable of receiving the second rigid pivot mounting rod 62. The second rod receiving element 130 may have a second pin entry hole 134 on a first side and a second pin exit hole 136 on a second, opposing side. In the preferred embodiment, the second cotter pin 132 extends transversely through the second pin entry hole 134, through the second rod cavity 99, and through the second pin exit hole 136, thereby securely coupling the second rigid pivot mounting rod 62 to the lower side walls 24.

In alternative embodiments, the first rod fastener 63 may be any device capable of securing the first rigid pivot mounting rod 61 to the lower side walls 24 including without limitation a nut and bolt. In alternative embodiments, the second rod fastener 64 may be any device capable of securing the second rigid pivot mounting rod 62 to the lower side walls 24 including without limitation a nut and bolt. One skilled in the art will recognize that there are various rod fastener configurations available.

It is to be understood that the optimum dimensional relationships for the parts of the present invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

The applicant intends to encompass within the language any structure presently existing or developed in the future that performs the same function. In the claims, any means-plus-function clause is intended to cover the structures described herein as performing the recited function and, not only structural equivalents, but also equivalent structures. Other substitutions, modifications, changes and/or omissions may be made in the design, operating conditions and arrangement of the preferred and other exemplary embodiments without departing from the spirit of the present invention.

What is claimed is:

1. A refuse container comprising:

(a) a lower member that comprises:

i) a bottom portion;

ii) lower side walls that are coupled to a perimeter of said bottom portion, said lower side walls defining a substantially vertical axis that extends upwardly from said bottom portion; and iii) lower wall edges at an upper end of said lower side walls that form a lower wall rim;

(b) upper wall sections comprising a first upper wall section and a second upper wall section, said upper wall sections each having a vertical hinged edge on a first side and a vertical seamed edge on a second, opposite side;

(c) upper wall edges at an upper end of said upper wall sections that form an upper wall rim, said upper wall rim defining an open top;

(d) a hinge for pivotally mounting said first upper wall section and said second upper wall section at said vertical hinged edges such that said first upper wall section and said second upper wall section are moveable in a first direction toward an open position and in a second, opposite direction toward a closed position; wherein said hinge comprises:

i) a spine wall coupled to a portion of said lower side walls and extending upwardly therefrom to align with said upper wall rim, vertical edges of said spine wall forming a first spine side on a first side and a second spine side on a second, opposing side;

ii) a plurality of first aligned spine hinge knuckles coupled to and extending outwardly from, said first spine side, said first aligned spine hinge knuckles being substantially tubular in shape;

iii) a plurality of second aligned spine hinge knuckles coupled to, and extending outwardly from, said second spine side, said second aligned spine hinge knuckles being substantially tubular in shape;

iv) a plurality of first aligned section hinge knuckles coupled to said vertical hinged edge of said first upper wall section, said first aligned section hinge knuckles being substantially tubular in shape, said first aligned section hinge knuckles fitting end-to-end between, and in axial alignment with, said first aligned spine hinge knuckles;

v) a plurality of second aligned section hinge knuckles coupled to said vertical hinged edge of said second upper wall section, said second aligned section hinge knuckles being substantially tubular in shape, said second aligned section hinge knuckles fitting end-to-end between, and in axial alignment, with said second aligned spine hinge knuckles:

vi) a first rigid pivot mounting rod extending vertically along an inside of said first aligned spine hinge knuckles and said first aligned section hinge knuckles, said first rigid pivot mounting rod slidably supported by said first aligned spine hinge knuckles and said first aligned section hinge knuckles;

vii) a first rod fastener that comprises a first rod receiving element coupled to said lower said walls, said first rod receiving element comprising:

(a) a first vertically oriented opening that has a size and shape that is complementary to said first rigid pivot mounting rod such that said first vertically oriented opening is capable of receiving said first rigid pivot mounting rod, said first rod receiving element having a first in entry hole on a first side and a first pin exit hole on a second, opposing side;

(b) a first rod cavity extending through said first rigid pivot mounting rod; and (c) a first cotter pin that extends transversely through said first pin entry hole, through said first rod cavity, and through said first pin exit hole thereby coupling said first rigid pivot mounting rod to said lower side walls and providing support to prevent said lower side walls from disengaging from said upper walls sections;

viii) a second rigid pivot mounting rod extending vertically along an inside of said second aligned spine hinge knuckles and said second aligned section hinge knuckles, said second rigid pivot mounting rod slidably supported by said second aligned spine hinge knuckles and said second aligned section hinge knuckles; and ix) a second rod fastener that comprises a second rod receiving element coupled to said lower said walls, said second rod receiving element comprising:

(a) a second vertically oriented opening that has a size and shape that is complementary to said second rigid pivot mounting rod such that said second vertically oriented opening is capable of receiving said second rigid pivot mounting rod, said second rod receiving element having a second pin entry hole on a first side and a second pin exit hole on a second, opposing side;

(b) a second rod cavity extending through said second rigid pivot mounting rod; and (c) a second cotter pin that extends transversely through said second pin entry hole, through said second rod cavity, and through said second pin exit hole thereby coupling said second rigid pivot mounting rod to said lower side walls and providing support to prevent said lower side walls from disengaging from said upper walls sections;

(e) at least one section fastener for securing said first upper wall section and said second upper wall section in a closed position; and (f) a wall securing device providing support for coupling said upper wall sections to said lower side walls.

2. The refuse container in accordance with claim 1, wherein said wall securing device comprises:

(a) an annular wall recess along an outer surface of said lower side walls, said annular wall recess forming a lower side wall concave groove;

(b) a first annular section protrusion along an inner surface of said first upper wall section;

(c) a second annular section protrusion along an inner surface of said second upper wall section, said second annular section protrusion being positioned symmetrically with said first annular section protrusion; and (d) said first annular section protrusion and said second annular section protrusion have a shape and size that is the same as each other, and that is complementary to a shape and size of said annular wall recess such that said annular wall recess is capable of receiving said first annular section protrusion when said first upper wall section is closed, and capable of receiving said second annular section protrusion when said second upper wall section is closed, thereby providing coupling support between said lower side walls and said upper wall sections.

3. The refuse container in accordance with claim 1, wherein said wall securing device comprises:

(a) an annular wall protrusion along an outer surface of said lower side walls;

(b) a first annular section recess along an inner surface of said first upper wall section, said first annular section recess forming a first section concave groove;

(c) a second annular section recess along an inner surface of said second upper wall section, said second annular section recess forming a second section concave groove; and (d) said first annular section recess and said second annular section recess having a shape and size that is the same as each other, and that is complementary to a shape and size of said annular wall protrusion such that said first annular section recess and said second annular section recess are capable of receiving said annular wall protrusion when in closed positions, thus providing coupling support between said lower side walls and said first upper wall section, and between said lower side walls and said second upper wall section.

4. The refuse container in accordance with claim 1, wherein said section fastener comprises:

(a) a first cooperating wall latch member that is coupled to an outer portion of said first upper wall section; and (b) a second cooperating wall latch member that is coupled to an outer portion of said second upper wall section, said second cooperating wall latch member being capable of releasably attaching to said first cooperating wall latch member thereby securing said upper wall sections one to the other in a closed position.

5. The refuse container in accordance with claim 1, wherein:

(a) said lower side walls are cylindrical in shape; and (b) said first upper wall section and said second upper wall section have a shape that is substantially similar to a shape of said lower side walls.

6. The refuse container in accordance with claim 1, wherein:

(a) said lower side walls have a shape that is generally rectangular; and (b) said first upper wall section and said second upper wall section have a shape that is substantially similar to a shape of said lower side walls.

7. The refuse container in accordance with claim 1, wherein:

(a) said first upper wall section and said second upper wall section have a shape that is substantially similar to a shape of said lower side walls; and (b) said upper wall sections and said lower side walls are tapered such that a circumference of said upper wall rim is larger than a circumference of said bottom portion.

8. The refuse container in accordance with claim 1, wherein:

(a) said first upper wall section and said second upper wall section have a shape that is substantially similar to a shape of said lower side walls; and (b) a circumference of said upper wall rim is the same as a circumference of said bottom portion.

9. The refuse container in accordance with claim 1, further comprising a top lid that is releasably attachable to said upper wall rim such that said top lid protects against intrusion by animals and contains odor when attached.

10. The refuse container in accordance with claim 1, further comprising a top lid, said top lid having at least one top lid handle for removably attaching said top lid to said upper wall sections.

11. The refuse container in accordance with claim 1, wherein said upper wall sections have at least one upper wall handle to aid in gripping and to facilitate dragging, lifting, pushing and pulling.

12. The refuse container in accordance with claim 1, wherein a wheel assembly is coupled to an underside of said bottom portion thereby facilitating movement by allowing the container to be rolled.

13. The refuse container in accordance with claim 1, wherein:

(a) a wheel assembly is coupled to an underside of said bottom portion thereby facilitating movement by allowing the container to be rolled; and (b) a tilt handle is coupled to said top lid to facilitate tilting and rolling the container on said wheel assembly.

* * * * *